US008899688B2

(12) United States Patent
Brown et al.

(10) Patent No.: US 8,899,688 B2
(45) **Date of Patent: *Dec. 2, 2014**

(54) CONVERTIBLE SWING SEAT

(71) Applicant: Backyard Leisure Holdings, Inc., Pittsburg, KS (US)

(72) Inventors: Patrick W. Brown, Auburn, OH (US); John R. Nottingham, Bratenahl, OH (US); John W. Spirk, Gates Mills, OH (US); Robert F. Soreo, Cleveland Heights, OH (US)

(73) Assignee: Backyard Leisure Holdings, Inc., Pittsburg, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/868,166

(22) Filed: Apr. 23, 2013

(65) Prior Publication Data

US 2013/0234483 A1 Sep. 12, 2013

Related U.S. Application Data

(63) Continuation of application No. 13/076,338, filed on Mar. 30, 2011, now Pat. No. 8,439,447.

(60) Provisional application No. 61/318,996, filed on Mar. 30, 2010.

(51) Int. Cl.

| | |
|---|---|
| ***A47D 1/00*** | (2006.01) |
| ***A47D 15/00*** | (2006.01) |
| ***A47D 13/10*** | (2006.01) |

(52) U.S. Cl.

CPC ..... *A47D 1/00* (2013.01); *A47D 13/105* (2013.01)

USPC ..... 297/467; 297/256.15

(58) Field of Classification Search

USPC ..... 297/118, 265.15, 487, 387.1, 467, 112, 297/283.2, 283.3, 92

See application file for complete search history.

(56) References Cited

U.S. PATENT DOCUMENTS 4,510,634 A * 4/1985 Diedrich et al. ..... 5/98.3
5,061,012 A * 10/1991 Parker et al. ..... 297/467

(Continued)

FOREIGN PATENT DOCUMENTS

| | | | | |
|---|---|---|---|---|
| CN | 2710959 | | 7/2009 | |
| CN | 101492022 | | 7/2009 | |
| WO | WO2006096712 | * | 9/2013 | ..... A63G 9/00 |

OTHER PUBLICATIONS

First Office Action including (English Translation) in counterpart Chinese Patent Application No. 2011800266599 entitled Convertable Swing(Action dated unknown).

*Primary Examiner* — David R Dunn
*Assistant Examiner* — Timothy J Brindley
(74) *Attorney, Agent, or Firm* — Hovey Williams LLP

(57) ABSTRACT

A convertible child seat includes a seat frame that presents a seat cavity and an open front to allow cavity ingress and egress by the child. The seat also includes a front restraint shiftably attached to the seat frame and shiftable between a storage position and a child-restraining position. In the storage position, the front restraint extends along the bottom wall so as to be positioned below the seated child and thereby permit cavity ingress and egress through the open front. In the child-restraining position, the front restraint at least partly spans the open front to restrict cavity ingress and egress through the open front.

19 Claims, 11 Drawing Sheets

(56) References Cited

U.S. PATENT DOCUMENTS 5,286,086 A * 2/1994 Gunji ..... 297/250.1
5,533,786 A * 7/1996 Cone, II ..... 297/256.15
5,700,054 A * 12/1997 Lang ..... 297/238
6,416,132 B1 * 7/2002 Norton et al. ..... 297/467

* cited by examiner

CONVERTIBLE SWING SEAT

RELATED APPLICATION

This is a continuation of U.S. application Ser. No. 13/076,338, filed Mar. 30, 2011, entitled CONVERTIBLE SWING SEAT, which claims the benefit of U.S. Provisional Application Ser. No. 61/318,996, filed Mar. 30, 2010, entitled SWING SEAT, each of which is hereby incorporated in its entirety by reference herein.

BACKGROUND

1. Field

The present invention relates generally to child seats. More specifically, embodiments of the present invention concern a swing seat that is convertible between an infant swing seat configuration and a toddler swing seat configuration.

2. Discussion of Prior Art

High chairs, booster seats, car seats, swing seats and other types of child seats are well known in the art. Conventional child seats are designed for different ages of children. For instance, a child seat may be designed for an infant baby, a toddler that is more capable of supporting themselves in a seated position, or a child of some age therebetween. Some conventional seats, such as car seats, are intended to accommodate children of different ages.

Prior art child seats are deficient for several reasons. For instance, conventional child seats are unable to securely hold a small infant while being reconfigurable to support a much larger toddler and while allowing the toddler to have greater range of movement than the infant.

SUMMARY

The following brief summary is provided to indicate the nature of the subject matter disclosed herein. While certain aspects of the present invention are described below, the summary is not intended to limit the scope of the present invention.

Embodiments of the present invention provide a child seat that does not suffer from the problems and limitations of the prior art seats set forth above.

A first aspect of the present invention concerns a convertible child seat that presents a seat cavity to receive a seated child. The convertible child seat broadly includes a seat frame and a front restraint. The seat frame includes a bottom wall and side panels that extend along opposite sides of the seat frame. The walls and side panels cooperatively present the seat cavity, with the bottom wall and side panels defining an open front of the seat frame that permits cavity ingress and egress by the child. The front restraint is shiftably attached to the seat frame and is shiftable between a storage position and a child-restraining position. The front restraint extends along the bottom wall in the storage position so as to be positioned below the seated child and thereby permit cavity ingress and egress through the open front. The front restraint presents at least one opening that permits the legs of the seated child to extend through the open front when in the child-restraining position. The front restraint at least partly spans the open front in the child-restraining position to restrict cavity ingress and egress through the open front.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein:

FIG. 1 is a perspective of a child swing seat constructed in accordance with a preferred embodiment of the present invention, showing a pair of swing seats in use as part of a playset and suspended on a playset frame, with one of the seats being in the toddler configuration (the right seat) and the other seat being in the infant configuration (the left seat);

FIG. 2 is a perspective of the child swing seats shown in FIG. 1, with the swing seat including a seat frame, a rear support panel, a front restraint, a shoulder harness attached to the front restraint and attached to one of the female connectors of the seat frame, and swing ropes that extend from the seat frame to a pair of clips, and showing the swing seat in an infant configuration where the support panel is in a seat back position and the front restraint is in a child-restraining position;

Figure 6:
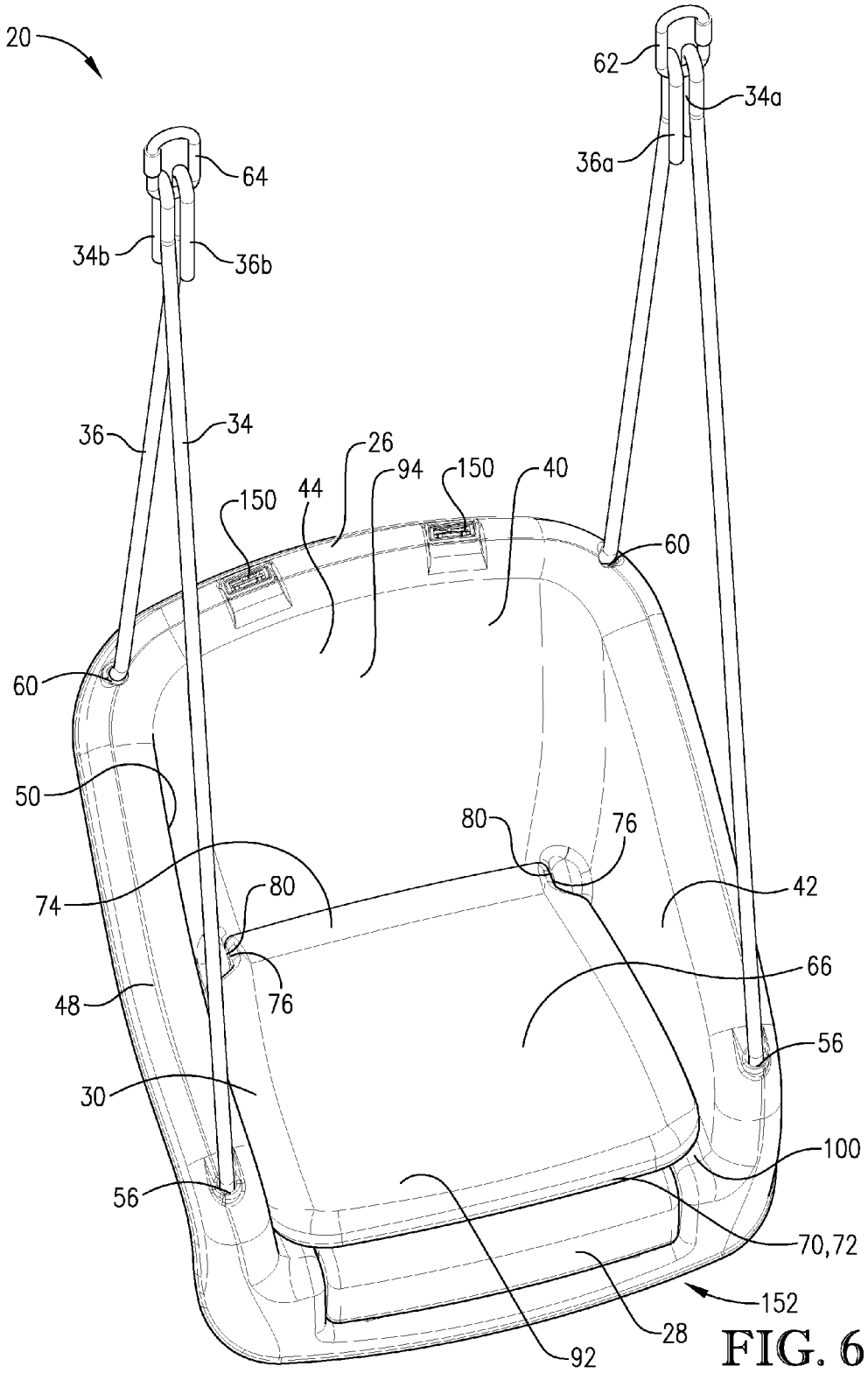
FIG. 6 is a perspective of the child swing seat of FIG. 4, but showing the swing seat in a toddler configuration, with the rear support panel pivoted into a seat bottom position to cover the front restraint in the storage position.
Figure 7:
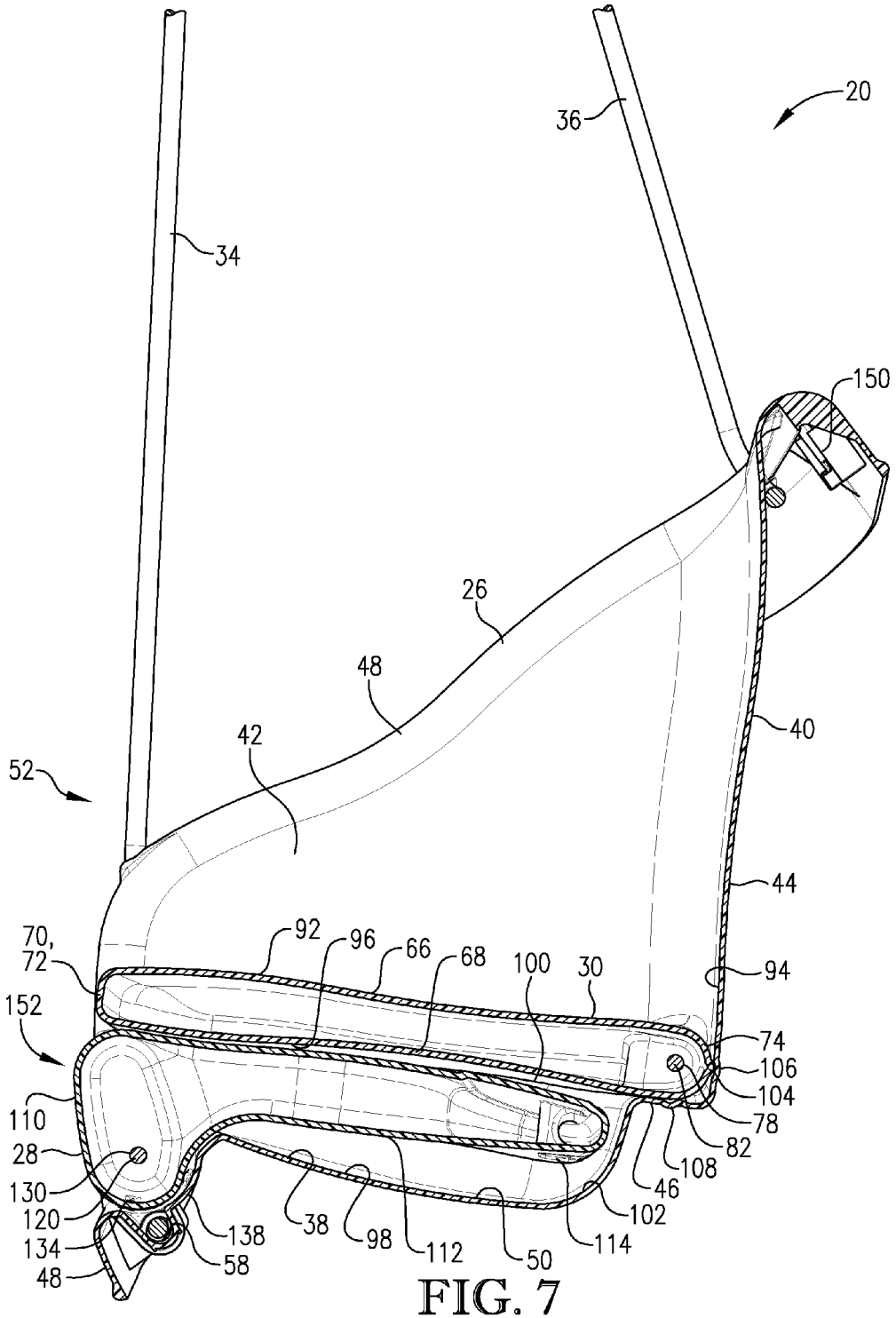
Figure 8:
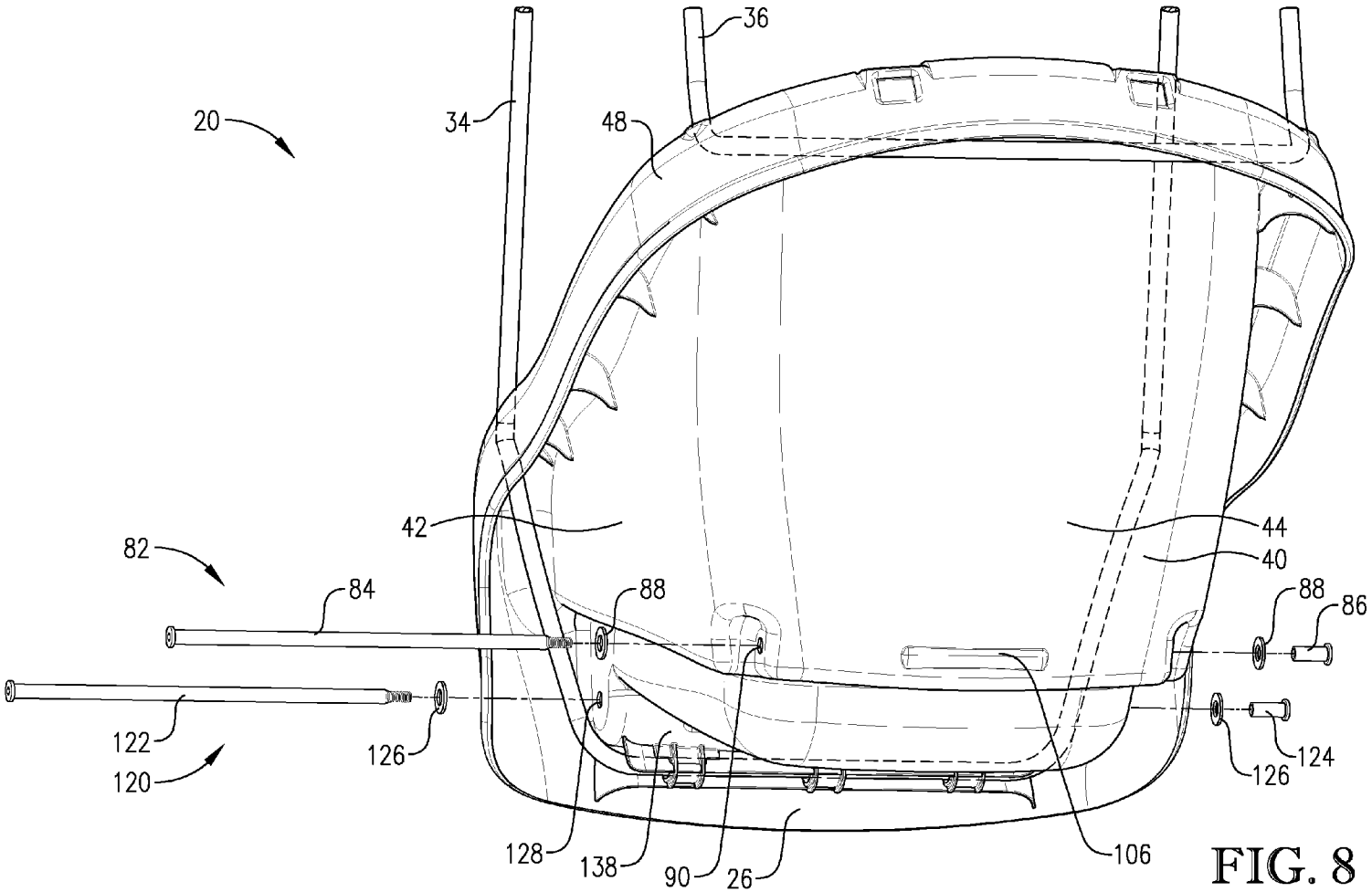
Figure 9:
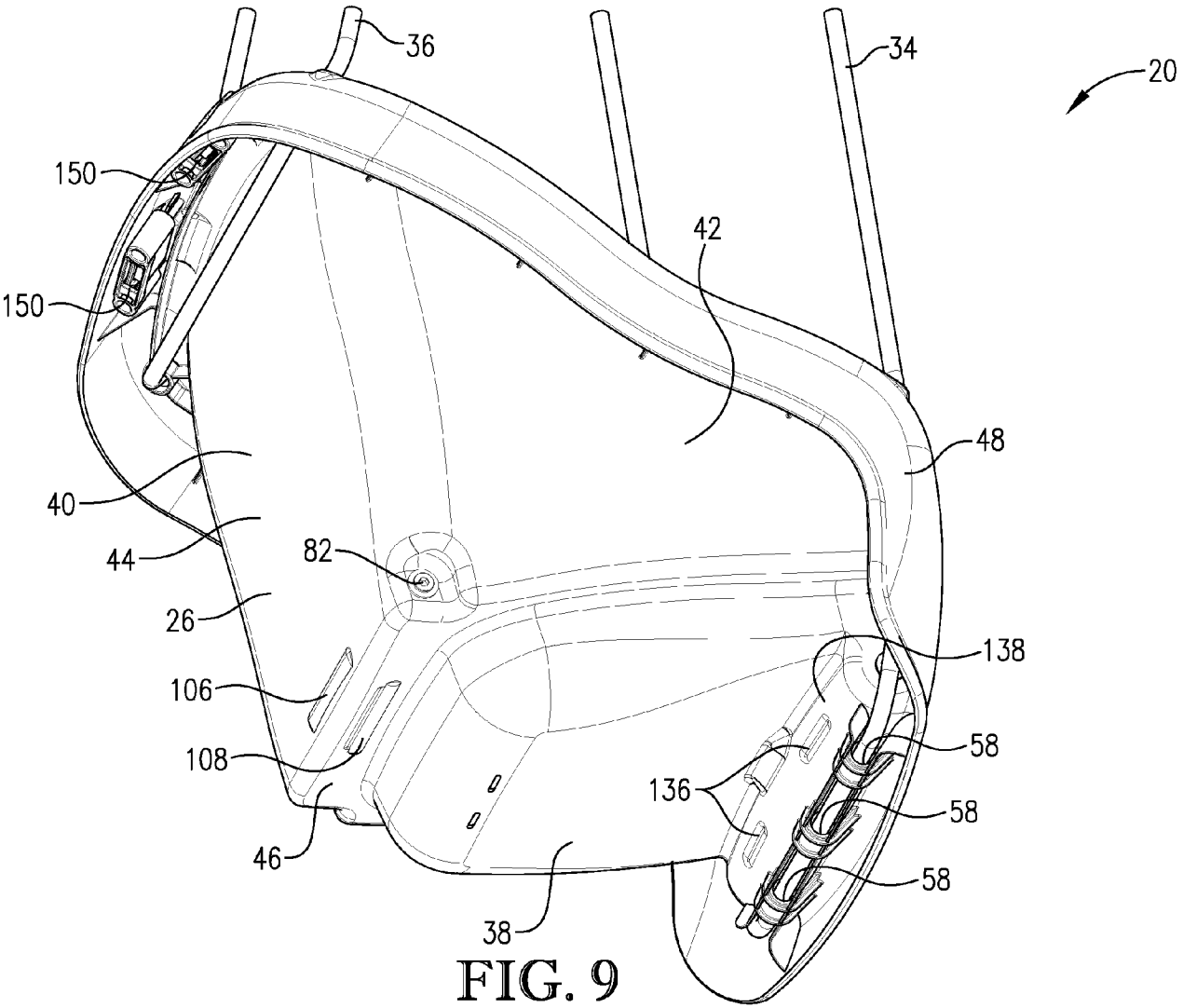
Figure 10:
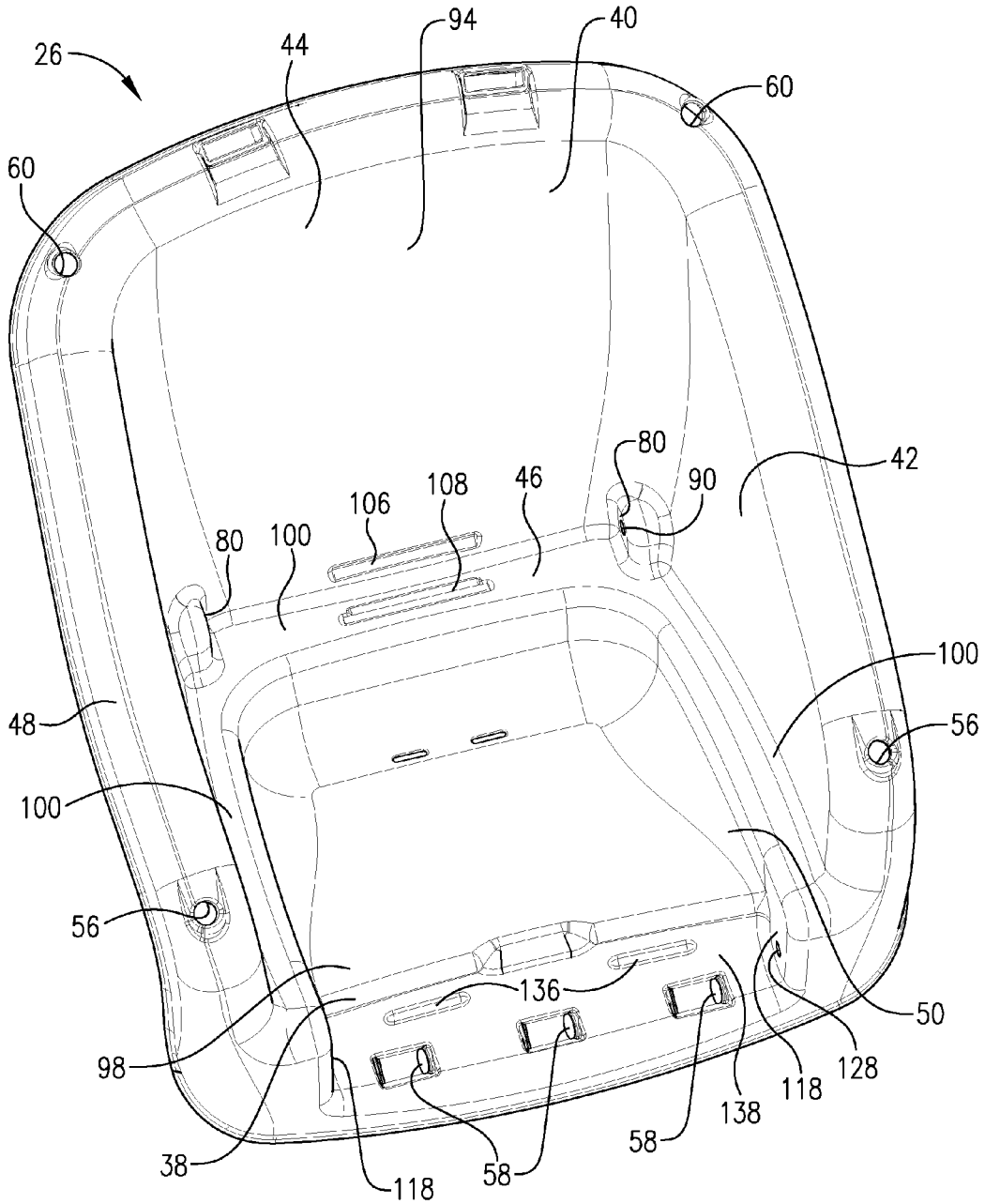
Figure 11:
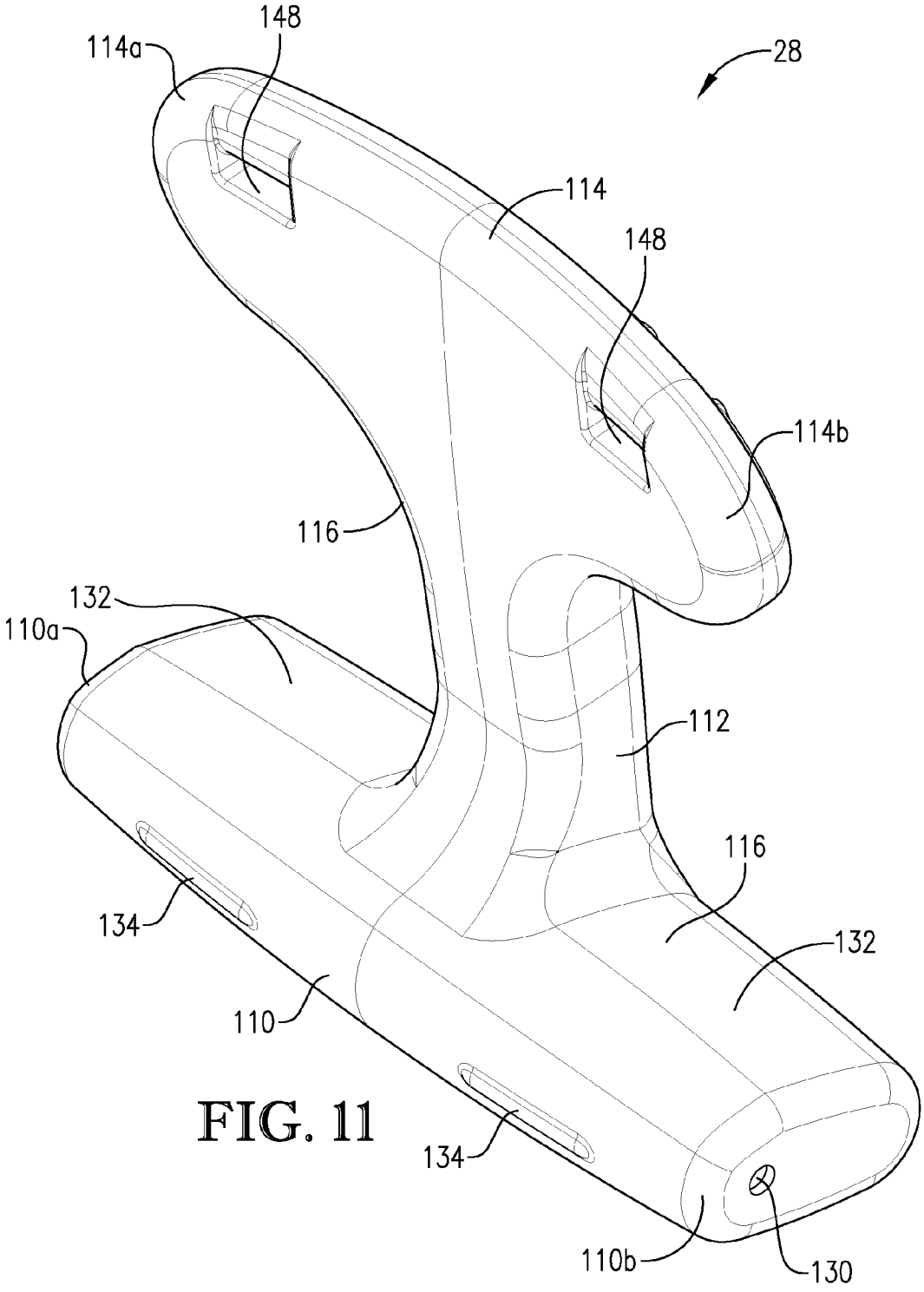

FIG. 7 is a fragmentary cross-section of the child swing seat shown in FIG. 6, showing the support panel and seat frame cooperatively forming a chamber that receives the front restraint in the toddler configuration, with the support panel and seat frame also presenting a front opening that communicates with the chamber and is spanned by a base of the front restraint, and showing panel detent elements engaged with one another to restrict movement of the support panel out of the seat bottom position;

FIG. 8 is a fragmentary rear perspective of the child swing seat shown in FIGS. 1-7, showing connector assemblies of the swing seat being exploded from the seat frame, with the connector assemblies being used to pivotally connect the support panel and front restraint to the seat frame;

FIG. 9 is a fragmentary lower perspective of the child swing seat shown in FIGS. 1-8;

FIG. 10 is a fragmentary upper perspective of the seat frame shown in FIGS. 1-9, showing the bottom wall, a rear wall, side panels, and a reinforcing rim of the seat frame, and showing panel detent elements located along the rear wall and front restraint detent elements located along a front margin of the bottom wall, with the female connectors not being shown; and FIG. 11 is a rear perspective of the front restraint shown in the previous drawings, showing the base, a safety bar, and a divider that interconnects the base and safety bar, with the safety bar presenting slotted openings to receive the shoulder harness and front restraint detent elements that extend along the base.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
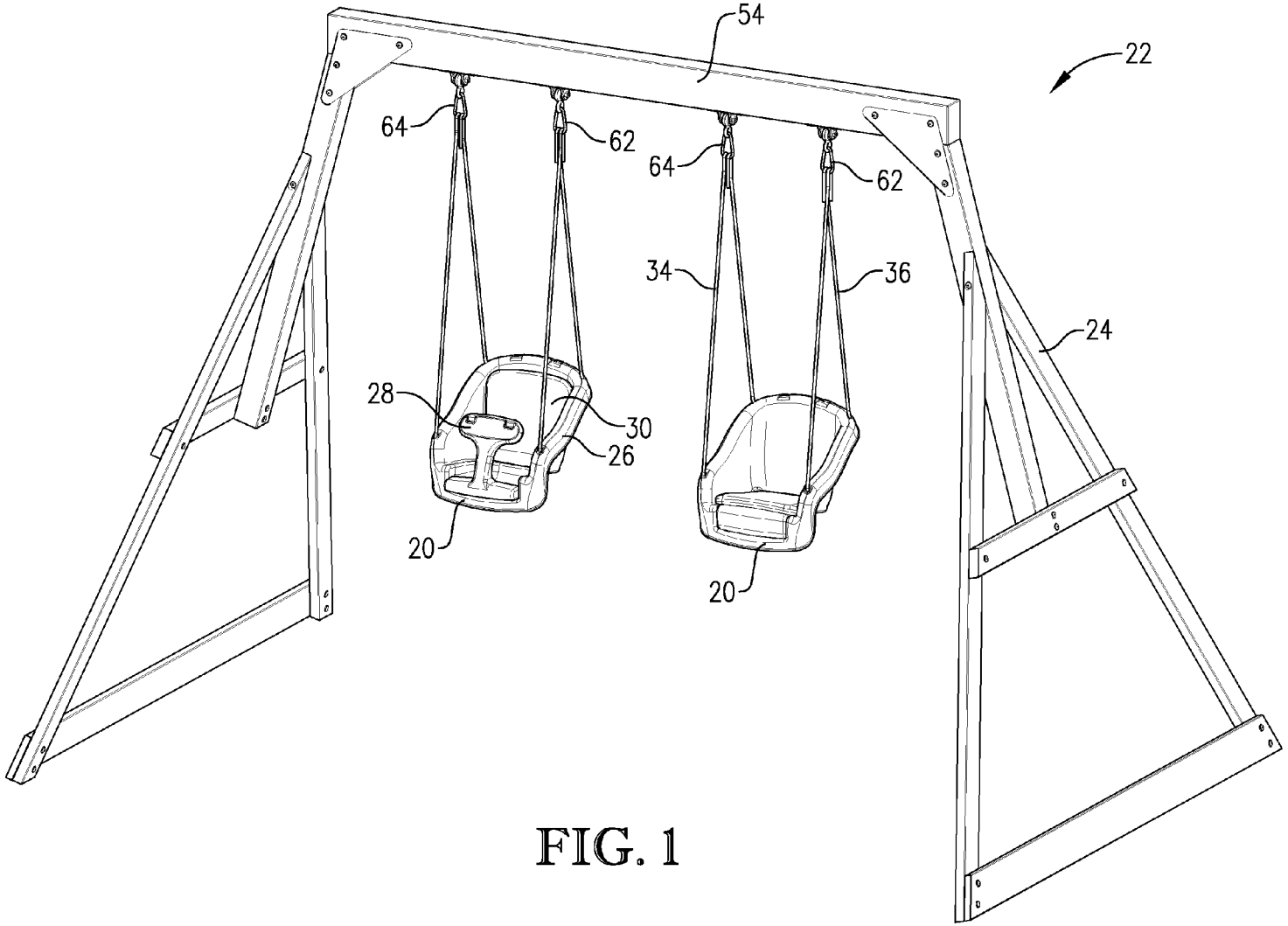
Figure 2:
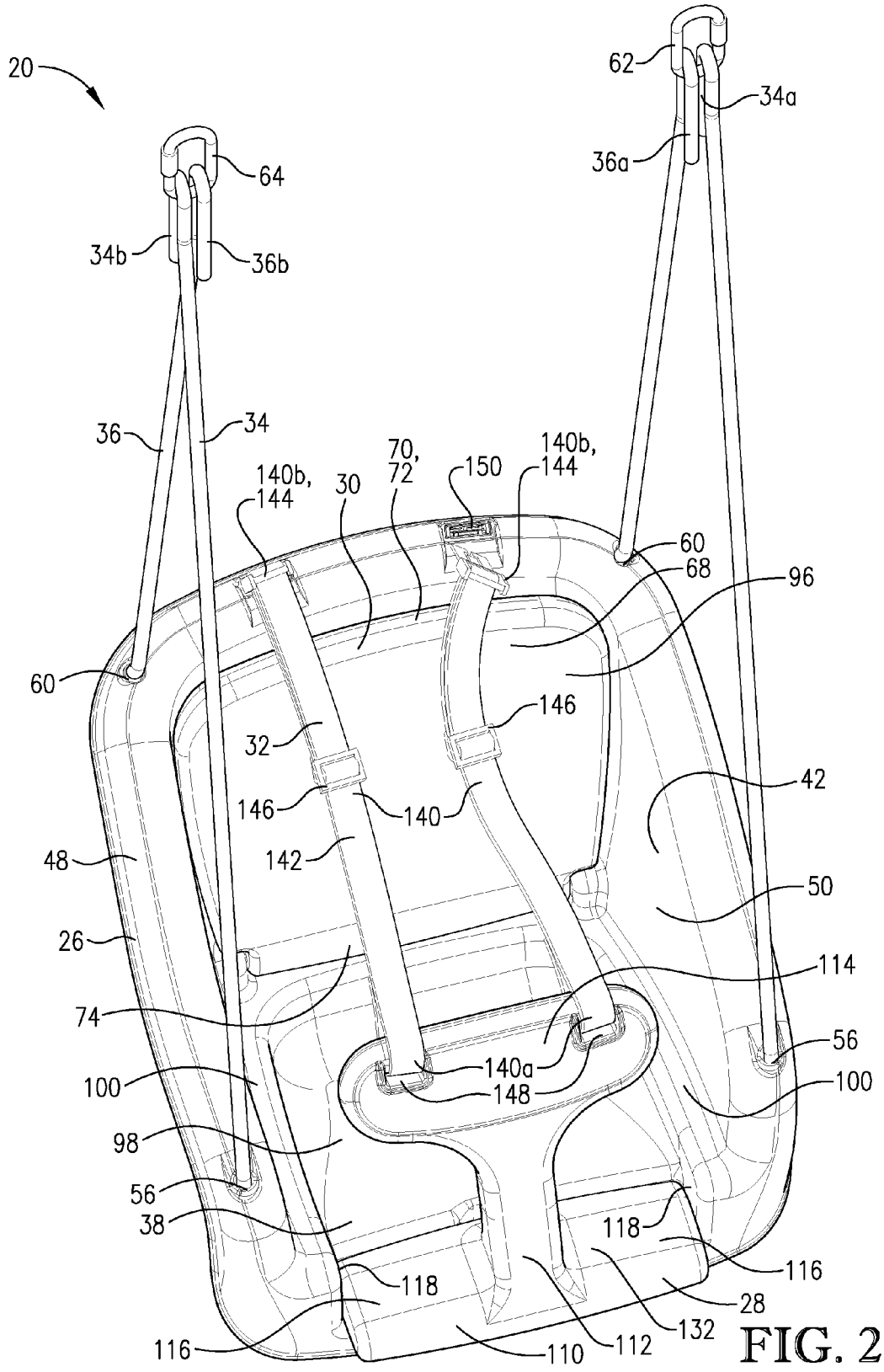
Figure 3:
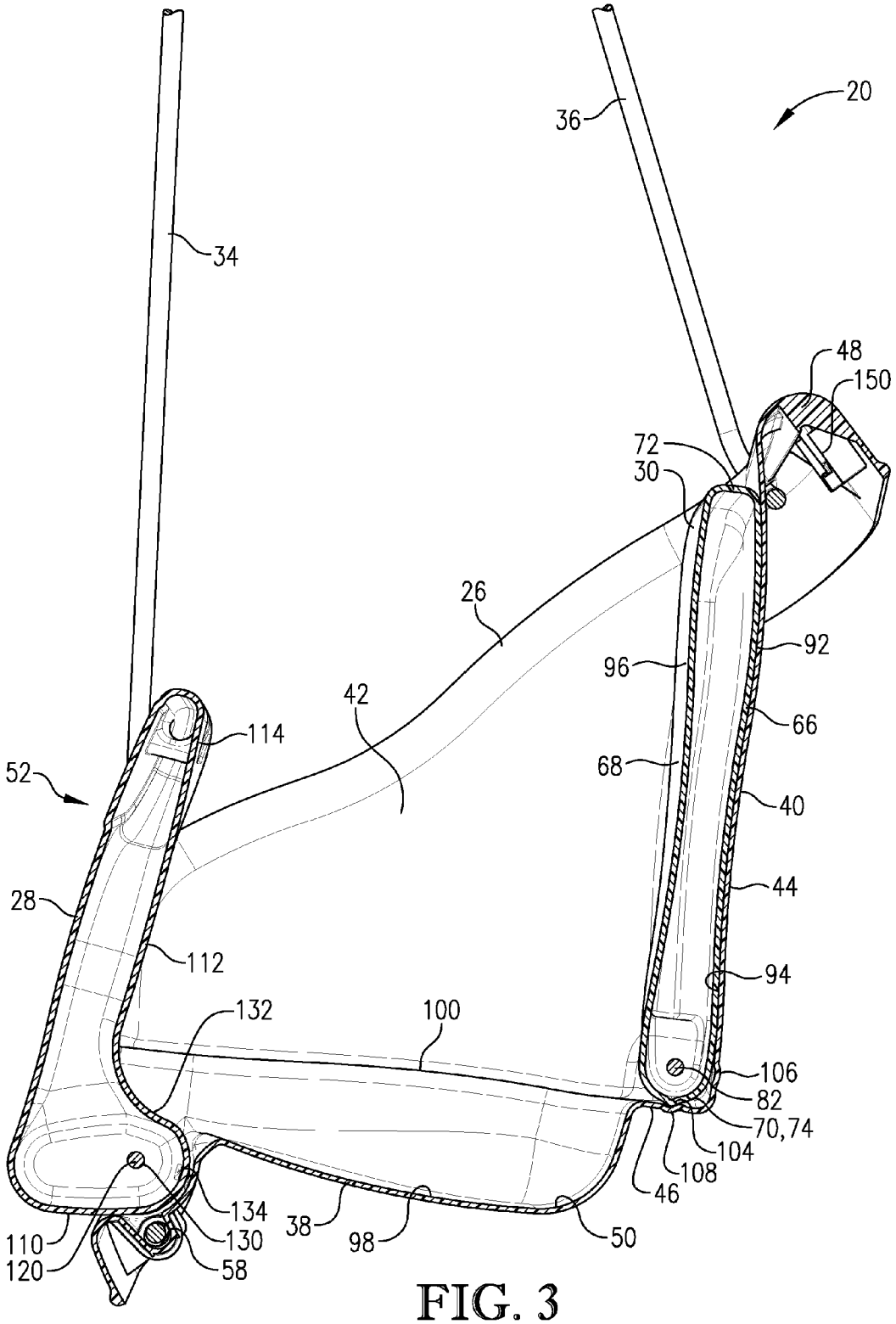
FIG. 3 is a fragmentary cross section of the child swing seat shown in FIG. 2, showing restraint detent elements engaged with one another to restrict movement of the front restraint out of the child-restraining position, and showing panel detent elements engaged with one another to restrict movement of the support panel out of the seat back position.

Turning initially to FIGS. 1 and 2, a child swing seat 20 is constructed in accordance with a preferred embodiment of the present invention. The illustrated swing seat 20 is provided as part of a playset 22 that also includes a playset frame 24 to support a pair of swing seats 20. While the seat 20 is preferably used as a child swing, it is also within the scope of the present invention to use the seat 20 to safely support an infant or toddler for other purposes. For instance, the illustrated seat construction could be used as part of a high chair, a booster seat, or a car seat. The swing seat 20 broadly includes a seat frame 26, a shiftable front restraint 28, a shiftable support panel 30, a shoulder harness 32, and front and back swing ropes 34,36.

Turning to FIGS. 2, 3, 9, and 10, the seat frame 26 is operable to support a child (not shown). The seat frame 26 preferably includes a bottom wall 38, a rear wall 40, and side panels 42 that extend along opposite sides of the seat frame 26 to interconnect the walls 38,40. The rear wall 40 includes a vertical section 44 and a ledge section 46 that spaces the vertical section 44 rearwardly of the bottom wall 38. The seat frame 26 also includes a reinforcing rim 48 that extends continuously along top margins of the rear wall 40 and side panels 42, and along a front margin of the bottom wall 38. Thus, the walls 38,40, side panels 42, and rim 48 cooperatively define a seat cavity 50 and an open front 52 that communicates with the seat cavity 50. However, it is within the ambit of the present invention where the seat frame 26 has an alternative construction, e.g., where the walls and/or panels are alternatively configured. For instance, the illustrated seat frame 26 could be devoid of rear wall structure, e.g., where the seat frame 26 is employed as part of a booster seat.

The illustrated seat frame 26 is preferably formed as a unitary structure to provide the swing seat 20 with suitable strength and rigidity. Preferably, the seat frame 26 comprises a molded unitary seat construction. However, it is within the scope of the present invention where the seat frame 26 is constructed of multiple components. Also, the seat frame 26 could be constructed by a process other than molding. The seat frame 26 is also preferably molded using a suitable synthetic resin material. However, the seat frame 26 could include other materials, such as wood or metal.

Turning to FIGS. 2, 8, and 9, the swing ropes 34,36 are used to suspend the seat frame 26 from a cross beam 54 of the playset frame 24. The front swing rope 34 is continuous and presents opposite left and right ends 34*a,b*. The rope 34 is preferably fed through front rim openings 56 and through holes 58 underneath the bottom wall so that the ends 34*a,b* are located above the seat frame 26 (see FIGS. 9 and 10).

Similarly, the back swing rope 36 is continuous and presents opposite left and right ends 36*a,b*. The rope 36 is preferably fed through back rim openings 60 and underneath a rear section of the rim 48 so that the ends 36*a,b* are located above the seat frame 26. The left ends 34*a*,36*a* of ropes 34,36 are secured to a left clip 62 with a binding (not shown) for attachment to the playset frame 24. The right ends 34*b*,36*b* of ropes 34,36 are secured to a right clip 64 with another binding (not shown) for attachment to the playset frame 24.

The principles of the present invention are applicable where the seat frame 26 is alternatively supported for swinging movement below the playset frame 24. For instance, the seat frame 26 could be supported by an alternative rope arrangement. Also, alternative supports, such as chain or rigid beams, could be used to suspend the seat frame 26 for swinging movement. Again, it is within the ambit of the present invention where the seat frame 26 is not suspended for use as a swing. For instance, supporting structure could be provided below the swing seat 26, e.g., where the swing seat 26 is used as part of a high chair, booster seat, or car seat.

Turning to FIGS. 2-8, the support panel 30 is preferably used to convert the swing seat 20 between infant and toddler configurations. As will be discussed, the support panel 30 also provides support surfaces for each of the configurations. The illustrated support panel 30 preferably comprises a unitary panel construction and includes upper and lower panel walls 66,68 that are joined along an edge 70 that extends endlessly about the panel 30. The illustrated panel 30 preferably presents a generally rectangular shape with front and rear panel margins 72,74. The illustrated panel 30 also presents opposite recessed shoulders 76 adjacent the rear panel margin 74 and holes 78 that extend through the shoulders 76 (see FIGS. 4-7). However, it is within the ambit of the present invention where the support panel 30 has an alternative construction, e.g., where the panel 30 includes multiple panel components shiftable relative to one another.

The illustrated support panel 30 is preferably formed as a unitary structure to provide suitable strength and rigidity. Preferably, the support panel 30 comprises a molded unitary construction. However, it is within the scope of the present invention where the support panel 30 is formed by a process other than molding. The illustrated support panel 30 is preferably formed of a suitable synthetic resin material. However, the support panel 30 could include other materials, such as wood or metal.

The support panel 30 is preferably swingably mounted to the seat frame 26 within the seat cavity 50, although the support panel 30 could be alternatively mounted, as will be discussed. In particular, the illustrated support panel 30 is located so that the shoulders 76 are positioned adjacent to corresponding shoulders 80 presented by the seat frame 26 (see FIGS. 4 and 10). The support panel 30 is preferably attached to the seat frame 26 by a connector assembly 82 that includes a threaded bolt 84, threaded nut 86, and washers 88 (see FIG. 8). The connector assembly 82 extends through holes 90 in the shoulders 80 of seat frame 26 and holes 78 in the shoulders 76 and permits pivoting of the support panel 30 relative to the seat frame 26. However, the support panel 30 could be alternatively pivotally attached to the seat frame 26 without departing from the scope of the present invention.

Turning to FIGS. 4-7, the attached support panel 30 is preferably selectively positionable in both a seat back position (see FIGS. 4 and 5) and a seat bottom position (see FIGS. 6 and 7). In the seat back position, the support panel 30 is located so that an upper surface 92 presented by the upper panel wall 66 preferably extends along and is in engagement with the rear wall 40. Furthermore, the support panel 30 is positioned in a pocket 94 formed by the vertical and ledge sections 44,46 of the rear wall 40 so that a lower surface 96 presented by the lower panel wall 68 is generally flush with a top surface 98 of the bottom wall 38 along a rear margin thereof. As will be discussed further, location of the support panel 30 in the seat back position is preferably associated with the swing seat 20 being in the infant configuration.

In the seat bottom position, the support panel 30 is preferably located so that the lower surface 96 of the support panel 30 rests on a ledge surface 100 presented by the seat frame 26 and extending along the sides and rear margin of the seat frame 26 (see FIGS. 7 and 10). Thus, the bottom wall 38 and support panel 30 cooperatively form a chamber 102, with the lower surface 96 generally opposing the top surface 98 of the bottom wall 38 (see FIG. 7). As will be discussed, the chamber 102 is configured to receive the front restraint 28 when in the seat bottom position. Furthermore, location of the support panel 30 in the seat bottom position is preferably associated with the swing seat 20 being in the toddler configuration.

The illustrated support panel 30 is preferably swingable between the seat back and seat bottom positions. However, it is within the scope of the present invention where the support panel 30 is alternatively attached to the seat frame 26 to be located in either of the positions. For instance, the support panel 30 could be removably attached to the seat frame 26, e.g., where the support panel 30 is slidable into and out of the seat back and seat bottom positions.

Turning to FIGS. 3-10, the swing seat 20 also preferably includes detent features that restrict pivotal movement of the support panel 30 out of the seat back and seat bottom positions. In particular, the support panel 30 preferably includes a male panel detent element 104 located along the rear panel margin 74 of the support panel 30. The rear wall 40 preferably includes female panel detent elements 106,108 located respectively on the vertical section 44 and on the ledge section 46 of the rear wall 40. Thus, when the support panel 30 is in the seat back position, the panel detent elements 104,108 engage one another and cooperatively restrict pivotal movement of the support panel 30 out of the seat back position (see FIGS. 3 and 5). Similarly, when the support panel 30 is in the seat bottom position, the panel detent elements 104,106 engage one another and cooperatively restrict pivotal movement of the support panel 30 out of the seat bottom position (see FIG. 7). While the panel detent elements are preferably formed in the respective walls, it is also within the ambit of the present invention to provide alternative detent features or other means for releasably securing the panel 30 in the seat back and seat bottom positions. For some aspects of the present invention, the swing seat 20 could be devoid of the panel detent elements.

Again, while the swing seat 20 preferably includes the illustrated support panel 30, it is within the scope of the present invention where the support panel 30 is alternatively configured. Furthermore, for some aspects of the present invention, the swing seat 20 could be devoid of the support panel 30.

Turning to FIGS. 2-7 and 11, the front restraint 28 is selectively used to safely restrain an infant (not shown) in the swing seat 20. The front restraint 28 preferably includes a laterally extending base 110, an elongated divider 112, and a laterally extending safety bar 114. The base 110 and safety bar 114 are vertically spaced apart and interconnected by the divider 112. The illustrated base 110 projects laterally in opposite directions from the divider 112 to present opposite base ends 110*a,b* (see FIG. 11). Similarly, the illustrated safety bar 114 projects laterally in opposite directions from the divider 112 to present opposite bar ends 114*a,b* (see FIG. 11). The base 110, divider 112, and safety bar 114 preferably define a pair of spaced apart openings 116 that are configured to receive the legs of the infant and permit the legs to extend through the open front 52, as will be discussed. However, it is within the ambit of the present invention where the front restraint 28 has an alternative configuration. For instance, the front restraint 28 could present alternative open areas for the infant's legs to extend through the open front 52, e.g., where the front restraint 52 presents a single central opening operable to receive both legs.

The illustrated front restraint 28 is preferably formed as a rigid unitary structure, although the front restraint 28 could have an alternative construction for some aspects of the present invention. For example, the restraint could alternatively have one or more flexible components for restraining child egress through the open front. Preferably, the front restraint 28 comprises a molded unitary construction. However, it is within the scope of the present invention where the front restraint 28 is alternatively formed, e.g., where the front restraint 28 includes multiple components. For instance, the front restraint 28 could include a tray removably attached to the safety bar 114 for use in feeding the seated child. The front restraint 28 is also preferably formed from a suitable synthetic resin material. However, the front restraint 28 could include other materials, such as wood or metal.

The front restraint 28 is preferably swingably mounted to the seat frame 26. In particular, the front restraint 28 is located so that base ends 110*a,b* are positioned adjacent to corresponding shoulders 118 presented along the front end the seat frame 26 (see FIGS. 2 and 10). The front restraint 28 is pivotally attached to the seat frame 26 by a connector assembly 120 that includes a threaded bolt 122, threaded nut 124, and washers 126 (see FIG. 8). The connector assembly 120 extends through holes 128 in the shoulders 118 (see FIGS. 8 and 10) and holes 130 in the base 110 (see FIG. 11). However, the front restraint 28 could be alternatively pivotally attached to the seat frame 26 without departing from the scope of the present invention.

Figure 4:
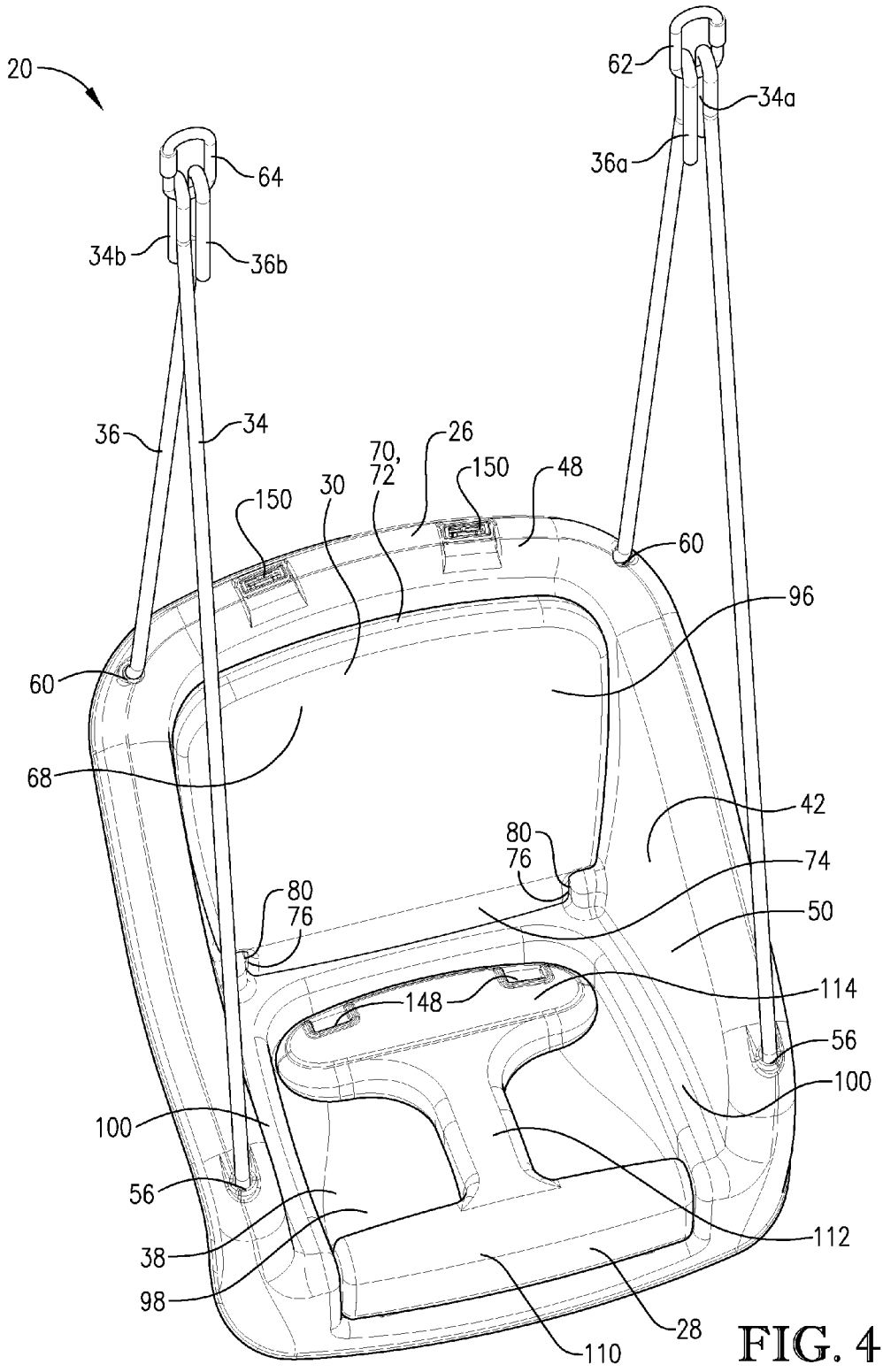
FIG. 4 is a fragmentary perspective of the child swing seat of FIGS. 2 and 3, but showing the front restraint pivoted into a storage position where the front restraint extends along a bottom wall of the seat frame.
Figure 5:
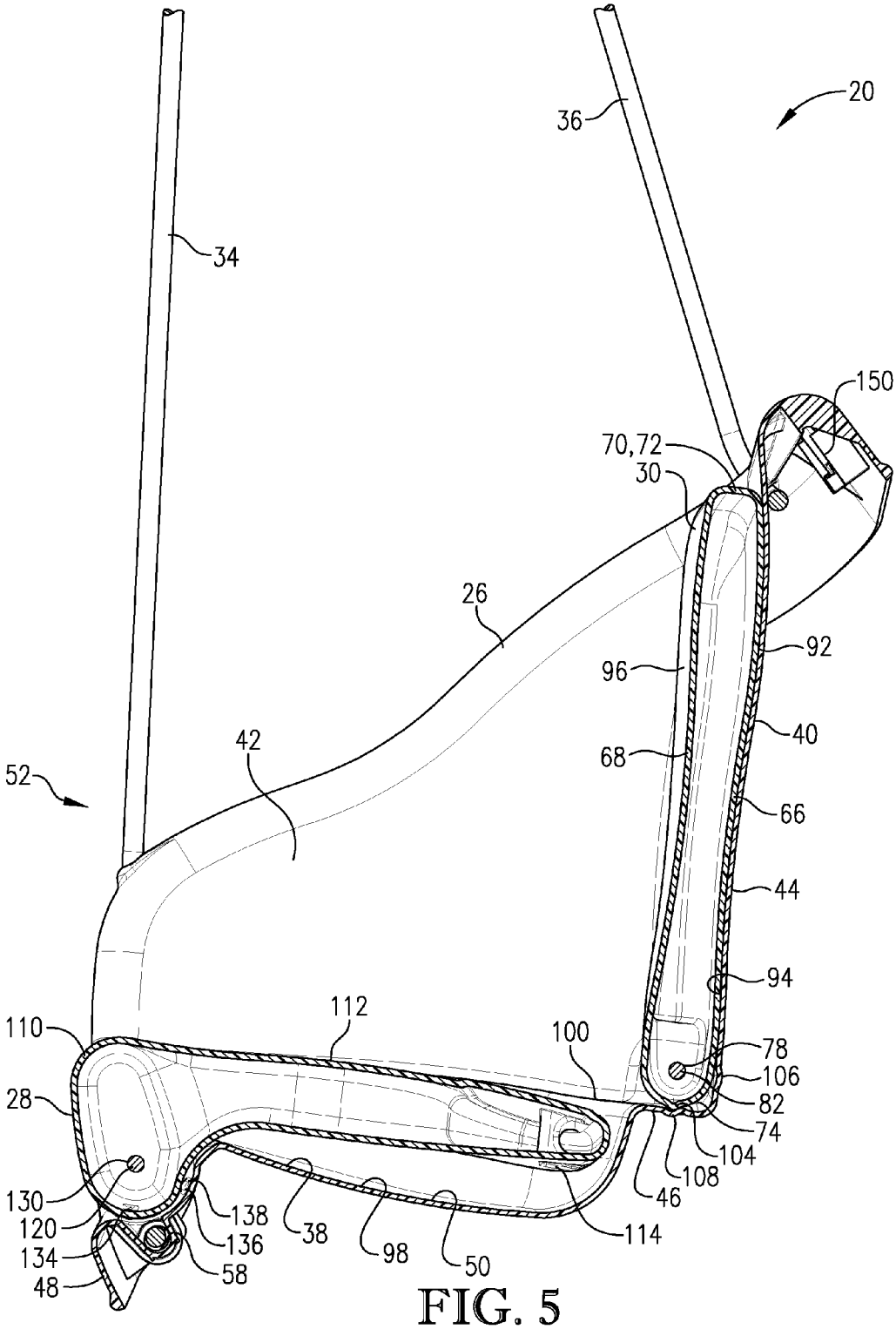
FIG. 5 is a fragmentary cross-section of the child swing seat shown in FIG. 4.

The attached front restraint 28 is preferably selectively positionable in both a child-restraining position (see FIGS. 2 and 3) and a storage position (see FIGS. 4 and 5). In the child-restraining position, the front restraint 28 is located so that the restraint 28 is generally upright and the safety bar 114 is vertically spaced above the base 110. The illustrated base 110 is positioned so that a top surface 132 of the base 110 is generally flush with the top surface 98 of the bottom wall 38 along a front margin thereof (see FIGS. 2, 3, and 11). The openings 116 of the front restraint 28 can receive the seated infant's legs and permit the legs to extend through the open front 52. At the same time, the front restraint 28 at least partly spans the open front 52 in the child-restraining position to restrict cavity ingress and egress through the open front 52.

In the infant configuration, location of the front restraint 28 in the child-restraining position is preferably associated with the support panel 30 in the seat back position. The swing seat 20 receives the seated infant with the infant's back adjacent the support panel 30. Again, the openings 116 of the front restraint 28 receive the seated infant's legs and permit the legs to extend through the open front 52.

The swing seat 20 also preferably includes detent features that restrict pivotal movement of the front restraint 28 out of the child-restraining position. In particular, the front restraint 28 preferably includes male restraint detent elements 134 located along the base 110 of the front restraint 28 (see FIG. 11). The bottom wall 38 preferably includes female restraint detent elements 136 located along a concave section 138 of the bottom wall 38 (see FIG. 10). When the front restraint 28 is in the child-restraining position, the restraint detent elements 134,136 engage one another and cooperatively restrict pivotal movement of the front restraint 28 out of the child-restraining position. While the restraint detent elements are preferably formed in the respective walls of the seat frame 26 and front restraint 28, it is also within the ambit of the present invention to provide alternative restraint detent features. For some aspects of the present invention, the swing seat 20 could be devoid of the restraint detent elements.

Turning to FIG. 2, the shoulder harness 32 is used to secure the seated infant in the seat cavity 50 when the swing seat 20 is in the infant configuration. The shoulder harness 32 includes a pair of straps 140. Each strap 140 includes an elongated flexible strip 142 formed in a loop at one end thereof, a male connector 144 slidably received on the strip 142, and a slidable buckle 146 attached to the other end of the strip 142. The connector 144 and buckle 146 are operable so that the strap 140 has an adjustable length and presents front and back ends 140*a,b*. The front ends 140*a* are each attached to one of the safety bar ends 114*a,b* by securing the looped end of the strap 140 in a slotted opening 148 presented by the safety bar 114. The male connector 144 provides the back end 140*b* and is removably attached to a corresponding female connector 150 mounted in the rim 48 adjacent the uppermost margin of the rear wall 40. When the straps 140 are secured to respective connectors 150, the illustrated straps 140 preferably extend longitudinally so as to extend over an infant's shoulders. The straps 140 are detachable from connectors 150 for storage of the shoulder harness 32 and front restraint 28 in the toddler configuration. It is also within the ambit of the present invention where the straps 140 are alternatively configured. Furthermore, the swing seat 20 could be devoid of the shoulder harness 32 for some aspects of the present invention.

In the storage position, the front restraint 28 is preferably located so that the front restraint 28 rests adjacent the bottom wall 38 of the seat frame 26, with the front restraint 28 located beneath the ledge surface 100 (see FIGS. 4 and 5). As mentioned above, the bottom wall 38 and support panel 30 cooperatively form the chamber 102 when the support panel 30 is in the seat bottom position. Thus, when the front restraint 28 is in the storage position, the front restraint 28 is received in the chamber 102. Consequently, the stored front restraint 28 is covered by the support panel 30 and located below the seated child so as to permit cavity ingress and egress through the open front 52. Furthermore, the detached straps 140 can be located with the front restraint 28 in the chamber 102. When the front restraint 28 is in the storage position and the support panel 30 is in the seat bottom position, the swing seat 20 is in the toddler configuration.

It is also within the ambit of the present invention where the front restraint 28 is alternatively stored relative to the seat frame 26. The seat 20 could be constructed so that the front restraint 28 is stored in a location below the bottom wall 38. For example, the front restraint 28 could pivot forwardly from the child-restraining position so as to be folded underneath the bottom wall 38. In such an alternative configuration, the seat 20 could be used without the illustrated support panel 30.

With the swing seat 20 in the toddler configuration, the front panel margin 72 of the support panel 30 is vertically spaced above a front end of the seat frame 26 so that the support panel 30 and seat frame 26 define a front opening 152 that communicates with the chamber 102 (see FIGS. 6 and 7). Because the front panel margin 72 rests adjacent to the base 110 in the toddler configuration, the base 110 preferably spans the front opening 152 to enclose the chamber 102 when the swing seat 20 is in the toddler configuration.

In use, the swing seat 20 is readily converted between the infant and toddler configurations. In the infant configuration, the support panel 30 is located in the seat back position and the front restraint 28 is located in the child-restraining position. Straps 140 of the shoulder harness 32 are releasably attached to connectors 150 to secure the infant within the seat cavity 50, with openings 116 permitting the legs of the infant to extend through the open front 52.

The swing seat 20 is shiftable from the infant configuration to the toddler configuration by initially detaching the straps 140 from the connectors 150. The front restraint 28 can then be pivoted downwardly from the child-restraining position to the storage position, with the detached straps 140 being positioned with the front restraint 28 below the ledge surface 100 and adjacent the bottom wall 38. The support panel 30 can then be pivoted from the seat back position to the seat bottom position so that the front restraint 28 and shoulder harness 32 are stored in the chamber 102 below the support panel 30. Thus, the seat 20 is configured to permit ingress and egress through the open front 52 by a child, particularly a toddler.

The swing seat 20 can be returned to the infant configuration by initially pivoting the support panel 30 from the seat bottom position to the seat back position. The front restraint 28 can then be shifted from the storage position to the child-restraining position. Thus, the infant can be placed in the seat cavity 50 so that the infant's legs extend through openings. The shoulder harness 32 can then be attached to connectors 150 to securely hold the seated infant in the swing seat 20.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A convertible child seat that presents a seat cavity to receive a seated child, said convertible child seat comprising:

a seat frame including a bottom wall, said seat frame presenting the seat cavity, side panels, and an open front that permits cavity ingress and egress by the child; and a front restraint shiftably attached to the seat frame and shiftable between a storage position and a child-restraining position, said front restraint extending along the bottom wall in the storage position so as to be positioned below the seated child and thereby permit cavity ingress and egress through the open front, said front restraint presenting at least one opening that permits the legs of the seated child to extend through the open front when in the child-restraining position, said front restraint at least partly spanning the open front in the child-restraining position to restrict cavity ingress and egress through the open front; and a support panel positionable in a seat bottom position, in which the support panel extends along the bottom wall so as to be located below the seated child and thereby provide a seat bottom, said support panel overlying and at least partly covering the front restraint when the support panel is in the seat bottom position and the front restraint is in the storage position, said front restraint being pivotally attached to the seat frame adjacent a front end thereof, said front restraint being located in the seat cavity in the storage position.

2. The convertible child seat as claimed in claim 1, said front restraint and said seat frame including complemental restraint detent elements that engage one another when the front restraint is in the child-restraining position and cooperatively restrict pivotal movement of the front restraint out of the child-restraining position.

3. The convertible child seat as claimed in claim 1, said front restraint including a central divider positioned between and at least partly defining a pair of laterally spaced leg openings that include the at least one opening.

4. The convertible child seat as claimed in claim 3, said front restraint including a lateral structure attached to the central divider, said lateral structure extending laterally outboard from the central divider to present opposite ends located adjacent respective side panels.

5. The convertible child seat as claimed in claim 4, said lateral structure including a bar, said central divider and said bar being attached in a T-shaped configuration, with the bar presenting opposite lateral ends; and harness straps attached to respective ends of the bar and the seat frame.

6. The convertible child seat as claimed in claim 1, said support panel being shiftably attached to the seat frame and shiftable between a seat back position and the seat bottom position, said support panel extending along a rear margin of the frame in the seat back position so as to be positioned behind the seated child and thereby provide a seat back.

7. The convertible child seat as claimed in claim 6, said support panel being pivotally attached to the seat frame adjacent a rear end thereof.

8. The convertible child seat as claimed in claim 7, said support panel and said seat frame each including a panel detent element, said panel detent elements engaging one another when the support panel is in the seat back position and cooperatively restricting pivotal movement of the support panel out of the seat back position.

9. The convertible child seat as claimed in claim 8, said seat frame including another panel detent element, said another panel detent element and said panel detent element of the support panel engaging one another when the support panel is in the seat bottom position and cooperatively restricting pivotal movement of the support panel out of the seat bottom position.

10. The convertible child seat as claimed in claim 7, said support panel presenting opposite support surfaces, one of said opposite support surfaces presenting the seat back and the other of said opposite support surfaces presenting the seat bottom.

11. The convertible child seat as claimed in claim 7, said support panel being located in the seat cavity in the seat bottom position.

12. The convertible child seat as claimed in claim 11, said support panel and said bottom wall cooperatively forming a chamber when the support panel is in the seat bottom position, said front restraint being at least partly received in the chamber when the front restraint is in the storage position and the support panel is in the seat bottom position, with the seat thereby being in a toddler configuration.

13. The convertible child seat as claimed in claim 12, said support panel being spaced from the seat frame along a front end thereof to at least partly define a front passage communicating with the chamber, said front restraint including a base that spans the front passage to restrict access to the chamber though the passage when the support panel is in the seat bottom position and the front restraint is in the storage position.

14. The convertible child seat as claimed in claim 13, said base of the front restraint being pivotally attached to the seat frame adjacent the front end thereof.

15. The convertible child seat as claimed in claim 14, said front restraint and said seat frame including complemental restraint detent elements that engage one another when the front restraint is in the child-restraining position and cooperatively restrict pivotal movement of the front restraint out of the child-restraining position.

16. The convertible child seat as claimed in claim 1, said support panel and said bottom wall cooperatively forming a chamber when the support panel is in the seat bottom position, said front restraint being at least partly received in the chamber when the front restraint is in the storage position and the support panel is in the seat bottom position, with the seat thereby being in a toddler configuration.

17. The convertible child seat as claimed in claim 16, said support panel being spaced from the seat frame along a front end thereof to at least partly define a front passage communicating with the chamber, said front restraint including a base that spans the front passage to restrict access to the chamber through the passage when the support panel is in the seat bottom position and the front restraint is in the storage position.

18. The convertible child seat as claimed in claim 17, said base of the front restraint being pivotally attached to the seat frame adjacent the front end thereof.

19. The convertible child seat as claimed in claim 18, said front restraint and said seat frame including complemental restraint detent elements that engage one another when the front restraint is in the child-restraining position and cooperatively restrict pivotal movement of the front restraint out of the child-restraining position.

* * * * *